United States Patent [19]

Smith

[11] 4,201,932

[45] May 6, 1980

[54] COLOR PURITY ADJUSTING METHOD

[75] Inventor: Joseph L. Smith, Indianapolis, Ind.

[73] Assignee: RCA Corporation, New York, N.Y.

[21] Appl. No.: 875,534

[22] Filed: Feb. 6, 1978

[51] Int. Cl.[2] ..... H01J 29/50; H01J 31/00

[52] U.S. Cl. ..... 315/13 C; 358/10

[58] Field of Search ..... 315/13 C, 368, 8; 335/212, 213; 313/429, 430; 358/10

[56] References Cited

U.S. PATENT DOCUMENTS

| | | | |
|---|---|---|---|
| 3,737,716 | 6/1973 | Gerritsen | 315/13 C |
| 3,748,526 | 7/1973 | Wedam | 315/13 C |
| 3,887,833 | 6/1975 | Yamazaki | 315/13 C |
| 3,916,437 | 10/1975 | Barbin | 358/10 |
| 4,137,548 | 1/1979 | Kelly et al. | 358/10 |
| 4,159,456 | 1/1979 | Smith | 335/210 |

FOREIGN PATENT DOCUMENTS

| | | |
|---|---|---|
| 1339970 | 12/1973 | United Kingdom . |
| 1507122 | 4/1978 | United Kingdom . |
| 2000635 | 1/1979 | United Kingdom . |
| 1540817 | 2/1979 | United Kingdom . |

OTHER PUBLICATIONS

Gerritsen, A New Method of Color Purity Adjustment, Mullard Tech. Communications 116, Oct. 1972, pp. 197–200.

*Primary Examiner*—Theodore M. Blum

*Attorney, Agent, or Firm*—Eugene M. Whitacre; Paul J. Rasmussen; Joseph J. Laks

[57] ABSTRACT

To adjust for color purity for a cathode ray tube, an auxiliary magnetic field magnetizes metallic components including the metal shadowmask. A remanent magnetic field is created upon removal of the auxiliary field and is used as an aid in purity adjustment. The cathode ray tube is operated to generate a color pattern on the screen and then purity is adjusted to produce a color pattern indicative of correct color purity.

13 Claims, 16 Drawing Figures

25
B G R
B G R
B G R
LEFT
CENTER
RIGHT (+y AXIS)
(+x AXIS)
Fx
Fx
Fx
Fx 50
53
52
51
54
36
BLUE
RED
GREEN
BLUE
RED

COLOR PURITY ADJUSTING METHOD

BACKGROUND OF THE INVENTION

This invention relates to a method of adjusting color purity for color cathode ray tubes.

Various adjustments must be performed on a color cathode ray tube of a television receiver to achieve faithful color reproduction on the cathode ray tube screen of a transmitted picture. These adjustments may be performed after assembling components, such as the deflection yoke, purity and convergence devices on the cathode ray tube neck, but before installation of the assembled tube in the receiver chassis; alternatively, they may be performed after installation of the assembled tube into the chassis housing.

The types of adjustments required for typical in-line cathode ray tubes include: (1) center purity; (2) yoke pullback or positioning of deflection yoke at the proper location along the cathode ray tube central axis to achieve overall color purity; (3) static or center convergence; and (4) overall convergence. These four adjustments are performed in a prescribed order which may vary with different tube and yoke combinations. Furthermore, they may be performed at differing station points during the assembly and/or installation process.

Conventional techniques for adjusting color purity usually involve adjusting center purity with the yoke pulled back away from the cathode ray tube screen as far as practical. Center purity is then adjusted with conventional apparatus, such as rotatable two-pole magnetic purity rings located about the cathode ray tube neck. Overall purity is then obtained by repositioning the yoke along the central axis until the deflection planes of the yoke and the cathode ray tube coincide.

For some cathode ray tube/deflection yoke combinations, there may be insufficient separation between one end of the yoke housing and the other apparatus located on the cathode ray tube neck to provide sufficient yoke pullback to permit center purity adjustment. It is desirable, therefore, to use a purity adjustment method that does not require yoke pullback. This method must be sufficiently flexible to be readily adaptable for use with various cathode ray tubes, yokes, and other components combinations, and readily adaptable to various adjustment sequences, and to be used at various station points during the cathode ray tube assembly and/or installation.

SUMMARY OF THE INVENTION

To adjust for color purity, a magnetic device capable of generating an auxiliary magnetic field is placed adjacent a cathode ray tube and magnetizes metallic components. The auxiliary field is of sufficient strength to create a remanent magnetic field when the auxiliary field is removed. The cathode ray tube is operated, and the remanent field creates a color pattern which is used to adjust for color purity.

Figure 3:
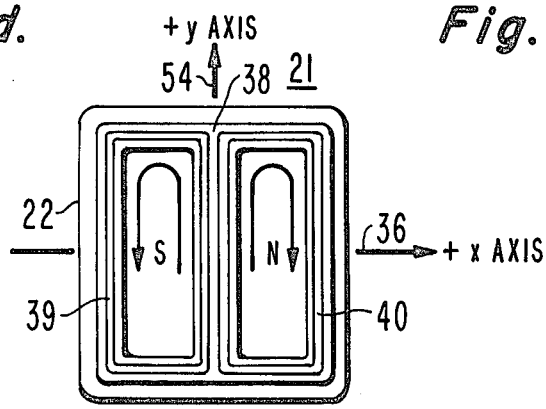
Figures 4, 5A, 5B, 5C:
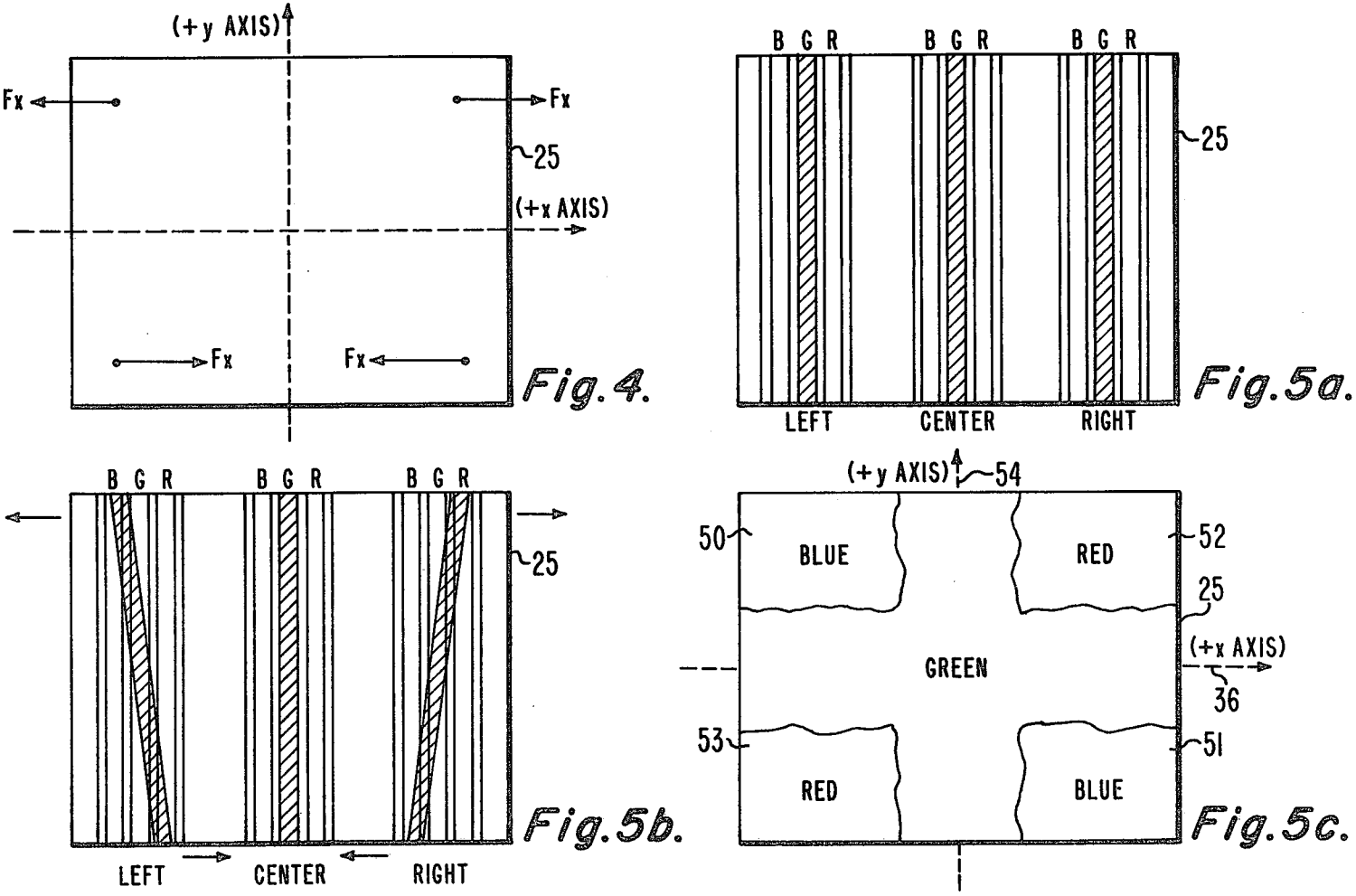

FIGS. *2a–2d* illustrate beam landing positions of an electron beam on phosphor stripes of a cathode ray tube screen;

FIG. 3 illustrates a magnetizing apparatus used to create a remanent magnetic field according to the invention;

FIG. 4 illustrates forces acting on an electron beam using a magnetic field according to the invention;

FIGS. *5a–5c* illustrate phosphor excitations and a screen color pattern for a cathode ray tube with correct color purity;

FIGS. *6a–6c* illustrate phosphor excitations and a screen color pattern for a cathode ray tube with register misalignment error; and FIGS. *7a–7c* illustrate phosphor excitations and a screen pattern for a cathode ray tube with incorrect deflection yoke axial position.

DESCRIPTION OF THE INVENTION

Figure 1:
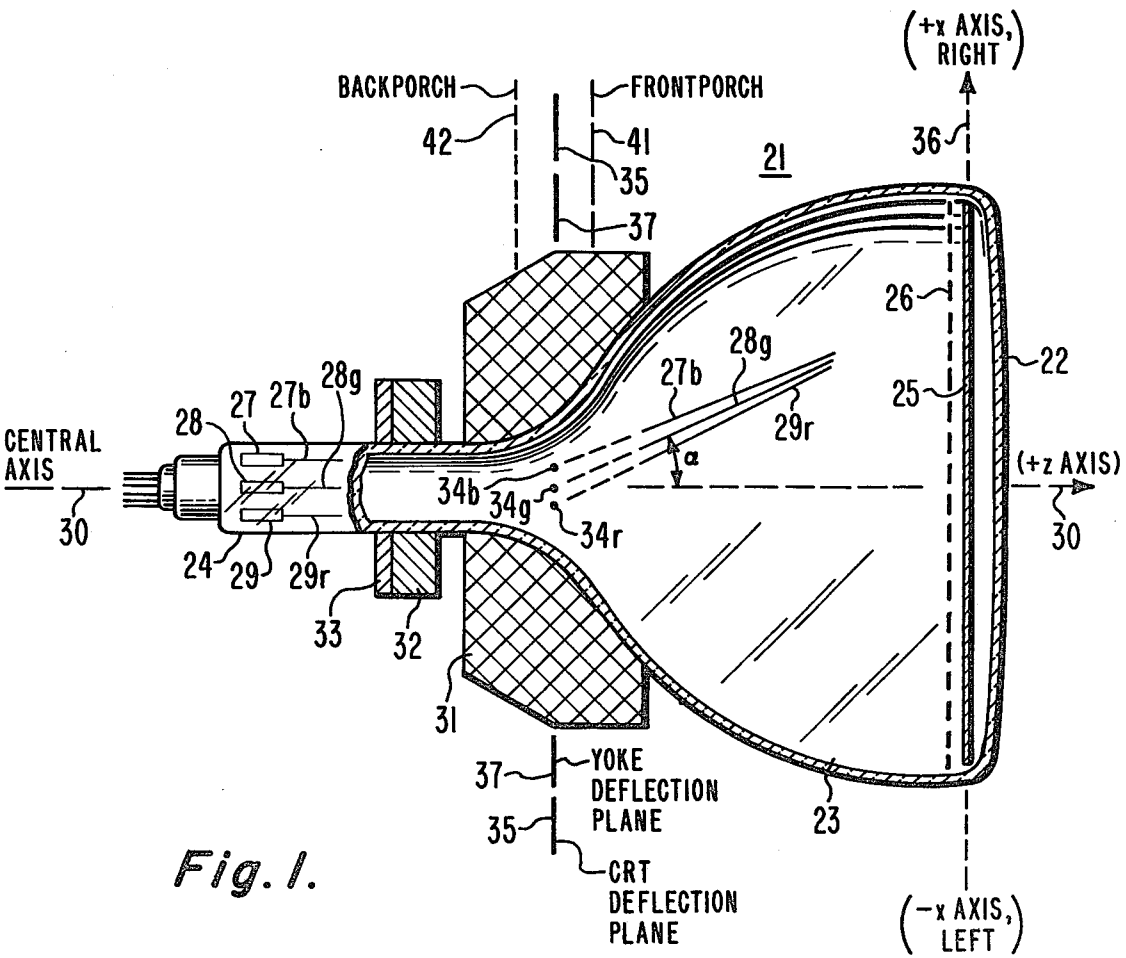
FIG. 1 illustrates a top elevation view of a color cathode ray tube partly in cross-section upon which a purity adjustment method according to the invention is used.

The in-line color cathode ray tube 21 of FIG. 1 includes a faceplate 22, a flared funnel portion 23, and a neck 24. Within cathode ray tube 21 adjacent the faceplate 22 are disposed a phosphor screen 25 and a metallized shadowmask 26. Omitted from FIG. 1 are other metallic components near the faceplate, such as a tension band and securing mechanisms for securing the screen and shadowmask in fixed relationships to each other and to other components associated with the cathode ray tube.

At one end of neck 24, within the cathode ray tube envelope, are located three in-line electron beam guns 27–29 for exciting the blue, green, and red phosphor stripes, respectively, on screen 25. The green beam is illustratively located along the central Z-axis 30. Disposed about the other end of neck 24 adjacent the flaring portion of funnel 23 is a deflection yoke 31, illustrated schematically in FIG. 1, including a housing within which are disposed vertical and horizontal deflection windings for deflecting the electron beams for generating a raster. Yoke 31 may also include quadripole windings for corner convergence. Disposed about neck 24 are a static convergence device 32 and a center purity adjustment device 33. Static convergence device 32 may comprise conventional four and six-pole rotatable pairs of magnetic rings. Center purity adjustment device 33 may comprise a conventional two-pole rotatable pair of magnetic rings which move all three in-line electron beams in a like direction parallel to the horizontal axis 36.

Figure 2A:
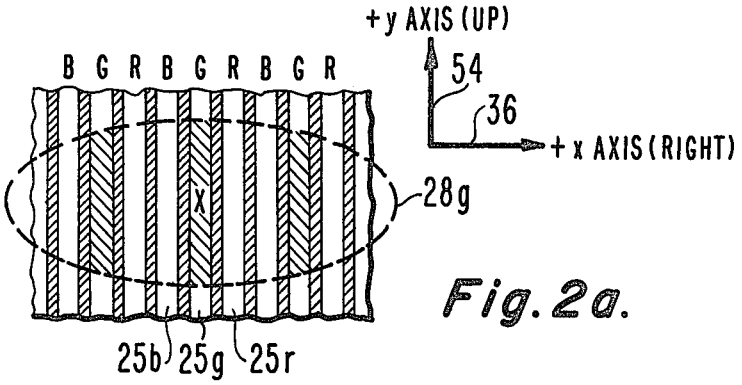

Consider, for example, the impinging of the green beam **28*g* at the phosphor screen 25, as illustrated in FIG. 2*a*. FIG. 2*a* illustrates a portion of the phosphor screen in the vicinity of an exemplary beam landing spot. The electron beam landing spot may typically be oval-like in shape with an area which will generally encompass a plurality of vertically or Y-axis 54 elongated phosphor stripes. The exact electron beam landing shape will vary with such factors as landing spot location, nature of the deflecting fields, and the cathode drive circuits and emitting surfaces. If the deflected electron beam 28*g* is incident at the shadowmask and screen at the correct angle, a properly positioned shadowmask 26 will prevent the green electron beam 28*g* from clipping adjacent red and blue phosphor stripes 25*r* and 25*b*. Only the green phosphor stripes 25*g* will be excited. The proper incident angle is obtained when the incident green electron beam 28*g* appears to originate from its corresponding green deflection center 34*g* of cathode ray tube 21. As illustrated schematically in FIG. 1, the blue, green, and red electron beams 27*b*, 28*g*, and 29*r* travel from their respective guns in a direction generally parallel to the central Z-axis, are then deflected by yoke 31 at a general angle $\alpha$, and then travel substantially undeflected to the screen 25 after leaving the influence of the yoke's magnetic field. The electron beams thus appear to originate at the respective red, green, and blue deflection centers 34***r, g, b.*

The deflection centers for a given cathode ray tube must be situated in a uniquely located cathode ray tube deflection plane 35 perpendicular to the central axis of the tube. If the deflection centers are not so located, the electron beams deflected away from the center of the screen will impinge on phosphor stripes other than their respective colors.

Due to register misalignment errors, such as gun and/or mask misalignment, the electron beams may not appear to intersect their respective deflection centers 34*b, g, r,* but may appear to intersect positions parallel to the horizontal or X-axis 36 of the cathode ray tube 21 that are to the left or right of the deflection centers. It should be noted that misalignment errors resulting in the beams intersecting positions above or below the deflection centers in a direction parallel to the vertical or Y-axis will not substantially create any purity errors for in-line systems with vertically elongated phosphor stripes.

Figure 2B:
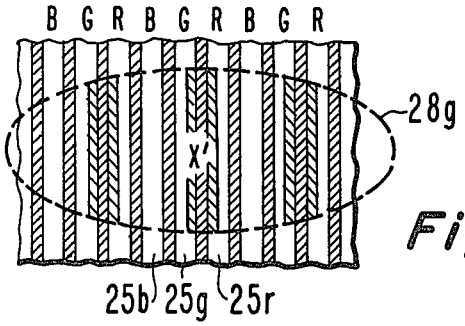

Consider a register misalignment, wherein the green beam 28*g,* for example, appears to intersect a position to the right of its deflection center 34*g.* As illustrated in FIG. 2*b,* the beam landing position is centered at X' also to the right of its nominal center landing position X on the green phosphor stripe 25*g.* The incident angle when passing through the shadowmask apertures will be incorrect, and the next adjacent red phosphor stripe 25*r* will be excited, given sufficient register misalignment, causing an impure color condition, as illustrated in FIG. 2*b.*

Another type of color purity error will occur if the deflection plane 37 of yoke 31 does not coincide with the cathode ray tube deflection plane 35. Overall color purity will be affected if the deflection yoke is incorrectly positioned along the central Z-axis of the cathode ray tube 21. Consider a situation where the yoke deflection plane 37 is forward of the cathode ray tube deflection plane 35. The incident angle at the shadowmask 26 is no longer $\alpha$ but a larger angle $\alpha'$.

Figure 2D:
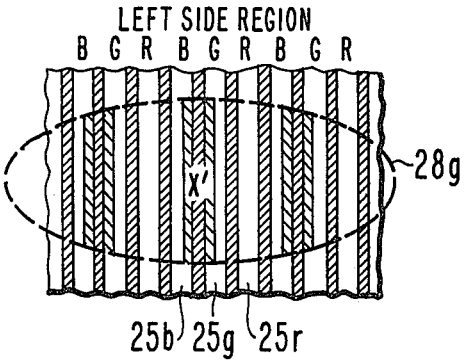
Figure 2C:
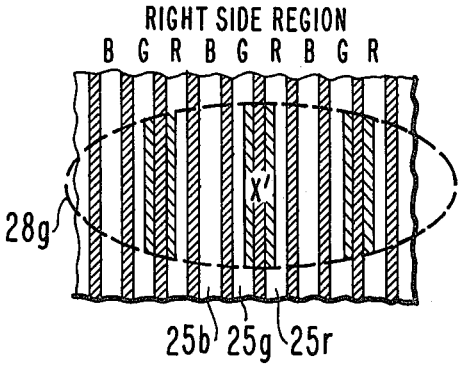

The green beam 28*g* landing spot is no longer centered at the center of the green phosphor stripe 25*g.* In the right-half portion of the screen 25, that is, in regions of positive X coordinate values, the landing spot center is to the right of the green phosphor stripe center, thereby exciting a portion of the red phosphor stripe 25*r,* as illustrated in FIG. 2*c.* In the left-half portion of the screen 25, the landing spot center is to the left of the green phosphor stripe center, thereby exciting a portion of the blue phosphor stripe 25*b,* as illustrated in FIG. 2*d.*

To adjust for center purity or correct register alignment, many conventional techniques involve pulling deflection yoke 31 as far back away from screen 25 as practical and observing the resulting screen color pattern caused by the undeflected electron beams of at least one electron gun, the green gun 28, for example. For in-line tubes with rectangular elongated vertical phosphor stripes, the pattern will comprise a generally rectangular vertically elongated generally green region which will not be centered in the phosphor screen if register misalignment exists. Purity rings 33 are then adjusted to center the rectangular pattern to achieve center color purity.

Such conventional techniques involving yoke pullback may not be readily adaptable to cathode ray tubes with relatively short necks. For such tubes, the distance between the rear of the deflection yoke 31 housing and the front of the static convergence 32 device housing located behind yoke 31 may be insufficient to permit enough of a yoke pullback to create a usable color pattern.

A feature of the invention includes a method of adjusting for color purity which does not involve yoke pullback and is sufficiently flexible to be used at different station points in the tube assembly or chassis installation, and is readily adaptable to many different tube adjustment sequences. As illustrated in FIG. 3, a coil holder 38 is placed next to the faceplate 22 of the cathode ray tube 21. Coil holder 38 comprises two current carrying conductor loops 39 and 40, with electron current in one loop flowing in a direction opposite that in the other loop. Omitted from FIG. 3 is the current generator for the coil loops which may be of conventional design. Loop 39 is positioned in the left-half of the screen 25 region, while loop 40 is positioned in the right-half.

With the currents flowing illustratively, as indicated in FIG. 3, an auxiliary magnetic field is developed in the vicinity of the screen 25 which is oriented substantially parallel to the central Z-axis 30. The polarity of the magnetic field in the right side region with positive X coordinate values is opposite that in the left side region. That is, $\vec{B}=+(B_Z)(\hat{Z})$ for $X>0$ and $\vec{B}=-(B_Z)(\hat{Z})$ for $X<0$, and $\vec{B}=0$ in the vicinity of $X=0$. The region of the screen behind loop 39 is traversed generally by a South polar field and behind loop 40 by a North polar field. No substantial field exists along the Y-axis, and because of the symmetry, the Y component of the magnetic field is relatively minimal.

The magnitude of the current flowing through loops 39 and 40 is selected to be large enough to create an auxiliary magnetic field of sufficient strength to permanently magnetize metallic components located in the vicinity of screen 25, such as the metallized shadowmask, the faceplate tension band, and securing mechanisms for the screen and shadowmask. The auxiliary magnetic field is then removed. A remanent magnetic field exists due to the magnetized metallic components. This remanent magnetic field will generally be of the same form as the auxiliary magnetic field produced by the current loops 39 and 40.

This remanent field may be used as a purity aiding magnetic field for establishing correct color purity. Since the purity aiding magnetic field is created by components solely part of the cathode ray tube, rather than by external fields created by external components attached to the tube faceplate or envelope, relatively great flexibility now exists in selecting appropriate station points at which to perform the purity adjustments and in selecting the exact sequence of the various adjustments to be performed.

The purity aiding remanent magnetic field interacts in the vicinity of the screen and shadowmask with the electrons emitted from the electron guns. A force $\vec{F}$ on the electron beams is developed, resulting in additional registry alignment errors, thereby creating a well-defined color pattern on the screen of the cathode ray tube. This pattern is used in adjusting for color purity. The force $\vec{F}$ is given by the vector cross-product $\vec{F}=(e)$ $(\vec{V})\times(\vec{B})$, where $\vec{V}$ equals the electron beam velocity in the vicinity of the screen and shadowmask, and B equals, as previously defined, and where X is symbolic of the vector cross-product operator.

Since, as explained previously, only horizontally directed register misalignments will result in the generation of a color pattern, only the X component $F_X$ of the force $\vec{F}$ is generally significant in generating a color pattern. From the above equation for $\vec{F}$, one determines that $F_X=(e)(V_Y)(B_Z)$, where $V_Y$ equals the Y component of the velocity $\vec{V}$.

In regions of screen 25 adjacent the horizontal and vertical axis of cathode ray tube 21, either $(V_Y)$ or $(B_Z)$ or both are substantially zero. Thus, as illustrated in FIG. 4, substantial X component forces $F_X$ exist only in regions near the screen corners with the force directions, as indicated by the arrows. $F_X=0$ substantially along both the X and Y axes and in the central region of the screen.

Other methods may also be used to obtain the purity aiding remanent magnetic field of the proper form. For example, a long vertical wire may be placed against the cathode ray tube 21 faceplate 22, the wire being directed along the Y-axis of the tube. The wire is then pulsed with current, thereby magnetizing metallic components near faceplate 22 and creating the appropriate remanent field.

With only the green gun 28 operating, for example, FIG. 5*a* illustrates the excitation of representative phosphor stripes (width not drawn to scale) in the left, center, and right regions of phosphor screen 25 for a cathode ray tube exhibiting no color impurity. Only the green phosphor stripes are excited. Interaction of the purity aiding magnetic field with the green electron beam 28*g* will result in the forces $F_X$ moving the electron beam from its correct landing positions in the directions indicated by the arrows of FIG. 5*b*, thereby exciting red and blue phosphors in a symmetrical manner in the corner regions of screen 25. As illustrated in FIG. 5*c*, for a cathode ray tube exhibiting no color impurity, the purity aiding remanent magnetic field creates a color pattern with appropriately color patches at corner regions 50–53 that are symmetrical in shape with respect to various lines of symmetry, such as vertical and horizontal axes, that may be drawn on screen 25.

Figure 6A:
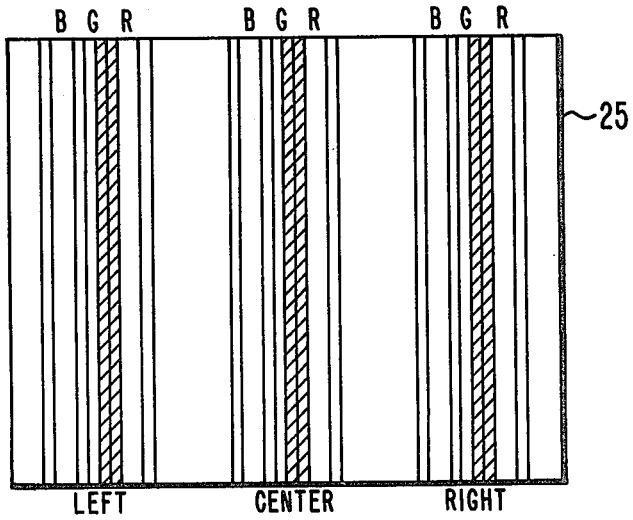
Figure 6B:
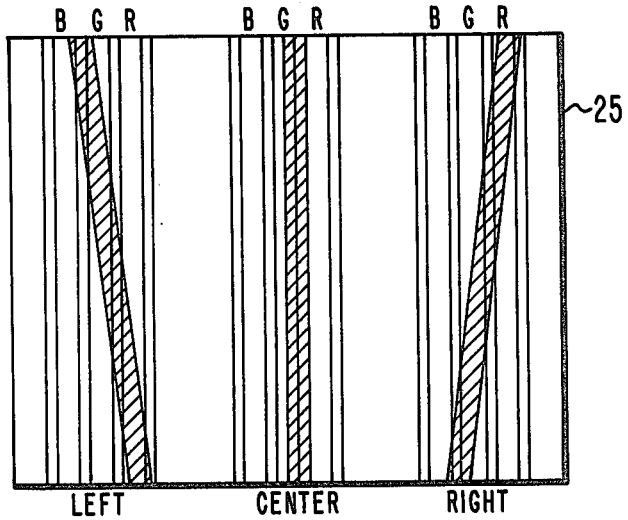
Figure 6C:
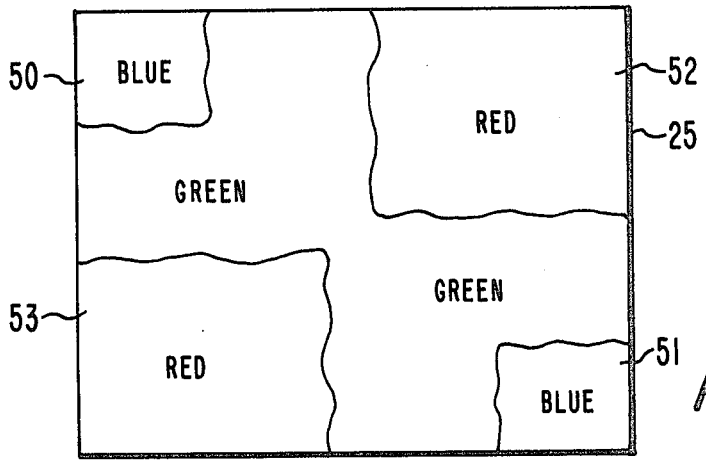

FIG. 6*a* illustrates the green beam 25*g* landing spots for representative phosphor stripes in the left, center, and right regions of screen 25 for a cathode ray tube exhibiting a registry misalignment, wherein the green beam 28*g* appears to originate, for example, from a point to the right (i.e., in the +X direction) of its deflection center 34*g*. FIG. 6*b* illustrates the phosphor excitation pattern on a tube with such a register alignment error when the purity aiding remanent magnetic field is used. The color pattern created on screen 25 by the purity aiding field is illustrated in FIG. 6*c*. The color patches at the corner regions of screen 25 are no longer symmetrical in shape. The blue patches 50 and 51 at the corners of one screen diagonal are smaller in area than the red patches 52 and 53 at the corners of the other screen diagonal.

Purity adjustment rings 33 are rotated until the color pattern illustrated in FIG. 5*c*, indicative of correct register alignment, is achieved. Thus, by using a purity aiding remanent magnetic field, center purity adjustment is performed without the necessity of yoke pullback.

Other guns may be used to establish the color purity of the color cathode ray tube. For example, the red gun 29 instead of the green gun 28 may be operated. The center region and regions along the X & Y axes of the screen will show a red color, whereas the corner regions will show alternating green and blue patches. A blue transparent filter may be placed in front of the faceplate to enhance the contrast between the green and blue patches to assist the operator in performing the color purity adjustments.

Figure 7A:
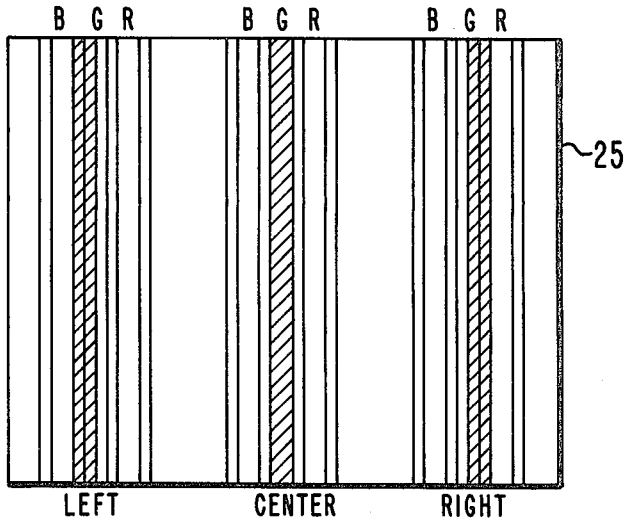
Figure 7B:
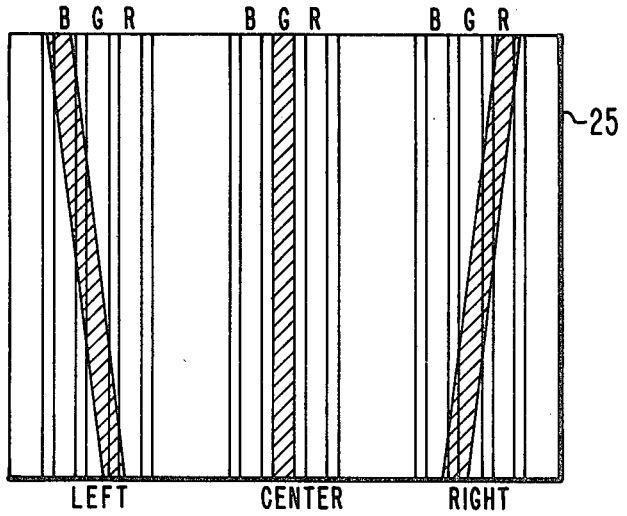
Figure 7C:
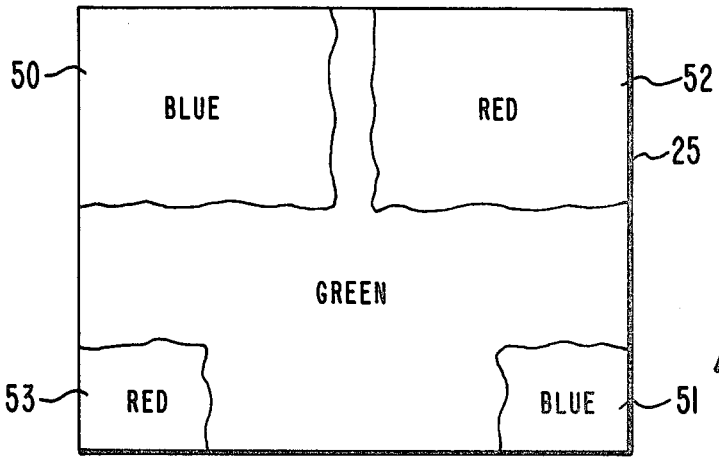

The purity aiding magnetic field may also be used to correctly position yoke 31 along the central Z-axis such that the yoke deflection plane 37 coincides with the cathode ray tube deflection plane 35, thereby adjusting for overall color purity. Consider an impure condition, for example, wherein the yoke deflection plane 37 is forward of the cathode ray tube deflection plane 35. FIG. 7*a* illustrates the green beam 28*g* landing spots for representative phosphor stripes in the left, center, and right regions of screen 25. The green beam landing spot will be centered to the left of the green phosphor stripe center in the left region of the screen and centered to the right in the right region. FIG. 7*b* illustrates the phosphor excitation pattern when the purity aiding remanent magnetic field is used. The color pattern created on screen 25 by the field is illustrated in FIG. 7*c*. The color patches are no longer symmetrical in shape. The blue and red upper corner region patches 50 and 52 are larger in area than the corresponding blue and red lower corner region patches 51 and 53.

To adjust for correct yoke axial position, the deflection yoke 31 is moved along the central axis 30 until the symmetrically shaped color pattern, illustrated in FIG. 5*c*, is displayed on screen 25. The yoke is then secured at that axial location by conventional mechanical or gluing means.

The method of purity adjusting using the color pattern generated by the purity adjusting remanent magnetic field according to the invention is sufficiently sensitive to align the yoke and cathode ray tube deflection planes 37 and 35 relatively closer to each other than when using the prior art visual adjusting technique.

The prior art visual technique involved generating a raster with only the green gun operating, for example. The yoke is then moved axially until no color other than green is observed on the screen. Using such a prior art technique, however, there exists a range of axial locations 41 through 42, as illustrated in FIG. 1, forward and backward of the correct cathode ray tube deflection plane 35 axial location wherein the displayed raster still exhibits a green color.

To place yoke 31 near the cathode ray tube deflection plane 35 axial location, the most forward extremity location 41, or frontporch, is located by forward yoke axial movement, and then the most backward extremity location 42, or backporch, is located by backward yoke axial movement. The midway location from these two extremes is then considered the cathode ray tube deflection plane 35 location. However, as mentioned previously, for some cathode ray tubes, e.g., those with relatively short necks, insufficient yoke pullback is available to reach the backporch axial location 42. For other cathode ray tube yoke combinations, the flaring portion of funnel 23 prevents movement of the yoke sufficiently forward to locate the frontporch location 41. Thus, the location of the cathode ray tube deflection plane 35 may be relatively difficult to determine.

Use of the purity aiding remanent magnetic field according to the invention, however, does not require any yoke pullback and does not require determining the front and/or back porches. Great flexibility is thereby provided to correctly adjust for color purity for a relatively large number of situations that may be encountered.

Since, as illustrated in FIG. 4, no, or relatively minimal, forces exist along the X and Y axes 36 and 54 and in the central regions of screen 25, all other adjustments, such as center convergence and yoke X-Y translation or yoke tilt, may be performed with the purity aiding remanent magnetic field still impressed in the metallic components of the cathode ray tube. Any number of adjustments in any desired sequence may be performed without the necessity of alternately magnetizing and demagnetizing the metallic components.

After all required adjustments are performed, the cathode ray tube is degaussed to remove the remanent magnetic field from the metallic components. A ringing sinewave current with an exponentially decaying amplitude may be coupled to current loops 39 and 40 to produce the degaussing field.

What is claimed is:

1. A method of adjusting for color purity of a color cathode ray tube, said cathode ray tube including purity adjusting apparatus, comprising the steps of:

placing magnetic apparatus adjacent said cathode ray tube capable of generating an auxiliary magnetic field and magnetizing metallic components of said cathode ray tube with said auxiliary magnetic field, said auxiliary magnetic field of sufficient strength to create upon the removal of said auxiliary magnetic field a remanent field of sufficient strength for use as an aid in adjusting the color purity of said cathode ray tube;

removing said auxiliary magnetic field;

operating said cathode ray tube to generate a color pattern upon the screen of said cathode ray tube by the interaction of said remanent field with at least one electron beam of at least one electron gun of said cathode ray tube; and adjusting said purity adjusting apparatus to obtain a color pattern indicative of a correct color purity.

2. A method according to claim 1 including the step of degaussing the magnetized metallic components of said cathode ray tube after obtaining a correct color purity.

3. A method according to claim 2, wherein said cathode ray tube comprises an in-line tube with Y-axis elongated phosphor stripes and wherein said auxiliary magnetic field creates a remanent magnetic field with a Z-axis oriented field component that reverses polarity across the Y-axis of the cathode ray tube screen for creating color patches in corner regions of said screen.

4. A method according to claim 3, wherein said auxiliary magnetic field creates a remanent magnetic field with no substantial Y-axis oriented field component.

5. A method according to claim 3, wherein said auxiliary magnetic field creates a remanent magnetic field that produces no X-axis directed forces in regions of the cathode ray tube screen adjacent the X & Y axes.

6. A method of adjusting for color purity of an in-line color cathode ray tube with phosphor stripes elongated substantially parallel to the vertical axis of said cathode ray tube, said cathode ray tube including purity adjusting apparatus, comprising the steps of:

generating within the vicinity of the screen of said cathode ray tube a purity aiding magnetic field, said purity aiding magnetic field including a component oriented substantially parallel to the central axis of said cathode ray tube in the vicinity of the screen, said field of a polarity in the region to one side of said vertical axis that is of a polarity opposite that in the region to the other side of said vertical axis;

operating at least one electron gun of said cathode ray tube to generate color patches at predetermined corner regions of said screen; and adjusting said purity adjusting apparatus to symmetrize said color patches with respect to a line of symmetry on said screen.

7. A method according to claim 6, wherein said purity aiding magnetic field includes no substantial vertical axis oriented field component.

8. A method according to claim 6, wherein no substantial horizontally directed forces on an electron beam are developed by said purity aiding magnetic field adjacent the horizontal and vertical axes of said cathode ray tube.

9. A method according to claim 6, wherein said purity aiding magnetic field comprises a remanent field created by magnetizing metallic components of said cathode ray tube.

10. A method of adjusting for color purity of an in-line color cathode ray tube with phosphor stripes elongated substantially parallel to the vertical axis of said cathode ray tube, said cathode ray tube including purity adjusting apparatus, comprising the steps of:

generating within the vicinity of the screen of said cathode ray tube a purity aiding magnetic field, said purity aiding magnetic field so oriented as to produce no substantial electron beam forces in a horizontal direction about the horizontal and vertical axes of said in-line cathode ray tube, said purity aiding magnetic field creating a color pattern on the screen of said cathode ray tube; and adjusting said purity adjusting apparatus to create a color pattern indicative of a correct cathode ray tube color purity.

11. A method according to claim 10, wherein the step of generating a purity aiding magnetic field comprises the step of energizing two current carrying conductor loops with oppositely directed magnetizing current, said conductor loops placed adjacent the cathode ray tube faceplate in opposite regions about said vertical axis.

12. A method according to claim 10, wherein said magnetizing current is of sufficient strength to create upon the removal of said magnetizing current a remanent magnetic field in metallic components of said cathode ray tube, said remanent magnetic field comprising said purity aiding magnetic field.

13. A method according to claim 12, including the step of degaussing the magnetized metallic components after obtaining said correct cathode ray tube color purity.

* * * * *